US006303401B2

(12) United States Patent
Nichterwitz et al.

(10) Patent No.: US 6,303,401 B2
(45) Date of Patent: Oct. 16, 2001

(54) METHOD FOR PRODUCING A METAL LAYER WITH A GIVEN THICKNESS

(75) Inventors: Marion Nichterwitz; Alexander Ruf, both of Dresden (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/729,066

(22) Filed: Dec. 4, 2000

(30) Foreign Application Priority Data

Dec. 2, 1999 (DE) ..... 199 58 202

(51) Int. Cl.[7] ..... H01Z 21/00
(52) U.S. Cl. ..... 438/17
(58) Field of Search ..... 438/14–18, 5–13, 438/800; 324/750–760

(56) References Cited

U.S. PATENT DOCUMENTS 6,054,868 * 4/2000 Borden et al. ..... 324/752

FOREIGN PATENT DOCUMENTS 30 04 149 A1 8/1981 (DE) .
30 34 175 C2 4/1982 (DE) .
0 067 432 B1 12/1982 (EP) .
0 146 720 B1 7/1985 (EP) .
3202499 9/1991 (JP) .
3211854 9/1991 (JP) .
6322539 11/1994 (JP) .
7022482 1/1995 (JP) .

OTHER PUBLICATIONS

D. Edelstein et al.: Full Copper Wiring in a Sub–0.25$\mu$ CMOS ULSI Technology, 1997 IEEE 0–7803–4103–1.

* cited by examiner

*Primary Examiner*—Charles Bowers
*Assistant Examiner*—Craig Thompson
(74) *Attorney, Agent, or Firm*—Herbert L. Lerner; Laurence A. Greenberg; Werner H. Stemer

(57) ABSTRACT

A method for producing a metal layer with a given thickness includes the step of measuring an electrical resistance of the metal layer via connections on a starting layer provided under the metal layer. The resistance measurement is performed during or after the deposition of the metal layer. The layer thickness of the deposited metal layer is determined from the resistance measurement. Depending on the thickness of the already deposited metal layer, the deposition process is continued or repeated until a metal layer with a desired thickness is produced.

31 Claims, 5 Drawing Sheets

METHOD FOR PRODUCING A METAL LAYER WITH A GIVEN THICKNESS

BACKGROUND OF THE INVENTION

Field of the Invention

The invention relates to a method for producing a metal layer with a given thickness, in particular to a method for producing a metal layer with a given thickness for an integrated component.

Modern data processing applications require a high computation performance. A major factor in providing such a high computation performance is the speed of the processor, or the speed of the core memory. As the complexity of the processors and of the core memory increases, and as the individual transistors become increasingly smaller, the speed of the processor is becoming ever less dependent on the speed of the individual transistors, and is being governed increasingly by the connections between the individual transistors. In this case, the delays, which are caused by the connections, decrease with a decreasing resistance of the individual connections.

Accordingly, one approach to increasing the speed of the processor or of the core memory is to reduce the resistance of the connections between the transistors. In the past, aluminum as mainly used for the connections (interconnects). Aluminum is used since it is relatively cheap, and can be structured relatively easily. Unfortunately, however, the resistance of an interconnect made of aluminum is relatively high. Furthermore, electromigration problems frequently occur in aluminum interconnects, and these can lead to failure of the integrated circuit.

Attempts have thus recently been made to replace the aluminum used for producing interconnects until now by other metals such as copper or silver. For example, copper has a considerably lower electrical resistance than aluminum and is distinguished by having a good electromigration behavior. Unfortunately, copper also has a number of negative characteristics. For example, copper can be structured only with great difficulty. The normal dry-etching processes which are used to structure aluminum interconnects can thus be used only with increased effort to structure copper interconnects. Furthermore, copper atoms very easily diffuse through silicon oxide, which is generally used for insulation. This can lead to the silicon oxide losing its insulating characteristics and copper atoms being able to reach the silicon substrate. Both effects can lead to total failure of the electrical circuits. The copper therefore has to be sheathed by a barrier layer, for example, of tantalum or tantalum nitride, in an appropriate manner during the production of interconnects.

Due to the above problems, the so-called damascene technique is generally used for producing copper interconnects. In this case, the structure of the interconnects which are still to be produced is first of all produced as trenches in an insulating layer. The trenches are then lined with a barrier layer and, finally copper is applied over the entire surface. In this case, the copper is applied such that it fills the trenches and a closed or uninterrupted copper layer is produced on the surface. This closed copper layer is then removed from the surface through the use of a CMP (chemical/mechanical polishing) step so that only the copper in the trenches remains. It is extraordinarily important for this CMP step that the copper layer always has a predetermined layer thickness.

The copper layer is normally produced through the use of an electrochemical method. To this end, the pre-structured substrate onto which the copper layer is intended to be applied is immersed in an electrochemical solution, from which the copper is deposited. The thickness of the deposited copper layer depends on the deposition parameters, such as the applied voltage, the deposition time and the state of the electrochemical solution. In order to ensure that the predetermined layer thickness is maintained over a number of silicon wafers, a so-called check wafer is in each case generally inserted before a specific number of silicon wafers, in order to determine the thickness of the copper layer. This measurement is then used as the basis to set the deposition time for the subsequent wafers.

However, this procedure is very time-consuming since the check wafer must be removed from the production process and taken to an instrument specifically provided for this purpose. The actual production process cannot continue until the thickness of the layer has been determined. The layer thickness measurement frequently then indicates that the copper layer has been deposited too thinly, as a result of which the check wafer, and, possibly, the wafers processed immediately before it, are unusable for further production, and must therefore be removed.

SUMMARY OF THE INVENTION

It is accordingly an object of the invention to provide a method for producing a metal layer with a given thickness which overcomes or at least eases the above-mentioned disadvantages of the heretofore-known methods of this general type.

With the foregoing and other objects in view there is provided, in accordance with the invention, a method for producing a metal layer with a given thickness, including the following steps:

a) providing a substrate;

b) applying a starting layer on the substrate;

c) electrically contacting the starting layer via connections at the edge of the substrate;

d) applying a metal layer through the use of a deposition method;

e) once the metal layer has been deposited, an electrical resistance measurement is carried out via the connections, and the layer thickness of the deposited metal layer is determined from the resistance measurement; and f) if necessary, at least one further deposition process is carried out, depending on the thickness of the already deposited metal layer, until a metal layer of a given thickness is produced.

With the objects of the invention in view there is also provided, a method for producing a metal layer with a given thickness, including the following steps:

a) providing a substrate;

b) applying a starting layer to the substrate;

c) electrically contacting the starting layer via connections at the edge of the substrate;

d) applying a metal layer through the use of a deposition method;

e) during the deposition of the metal layer, an electrical resistance measurement is carried out via the connections, in particular continuously or at given time intervals, and the layer thickness of the deposited metal layer is determined from the resistance measurement; and f) carrying out the deposition process, depending on the thickness of the already deposited metal layer, until a metal layer of a given thickness is produced.

The methods according to the invention have the advantage that each substrate, for example, each semiconductor wafer, can be measured and thus monitored with a minimal time loss. Accordingly, a given layer thickness can be maintained over a large number of wafers with high accuracy. No semiconductor wafer need be removed from the production process, and the number of unusable semiconductor wafers can be considerably reduced. Since the layer thickness is determined automatically in the methods according to the invention, the corresponding operator labor time can be saved.

According to a preferred embodiment, an electrochemical deposition is used for depositing the metal layer. In this case, it is particularly preferable for the current for the electrochemical deposition process to be passed through the connections which make contact with the starting layer. As a result, there is then no need for any additional connections for determining the metal layer thickness.

According to a further preferred embodiment, a copper layer is deposited. In this case it is preferable for a copper, titanium, titanium nitride or tantalum layer to be used as the starting layer. Furthermore, it is particularly preferable for the copper layer to be deposited from a solution which contains copper sulfate, sulfuric acid and hydrochloric acid, as well as leveling agents and brightening agents. Possible leveling agents are in this case amines, amides or imides. For example, it is possible to use a leveling agent available under the trademark name "MLO" which is produced by Enthone-OMI Inc., New Haven, Conn. As the brightening agent, a substance available under the trademark name "MD", which is likewise produced by Enthone-OMI Inc., New Haven, Conn., can for example be used.

The resistance measurement is preferably carried out diagonally across the substrate, for example the semiconductor wafer. In this case, it is preferable for the resistance measurement to be carried out as a 4-point measurement or as a Van der Pauw measurement. Furthermore, and in particular, it is preferable for a large number of connections to be provided, and for the resistance measurement to be carried out along a large number of directions diagonally across the substrate. This allows inhomogeneities in the thickness of the deposited layer to be identified. It is furthermore preferable for the resistance measurement to be carried out at a given frequency.

Other features which are considered as characteristic for the invention are set forth in the appended claims.

Although the invention is illustrated and described herein as embodied in a method for producing a metal layer with a given thickness, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 3:
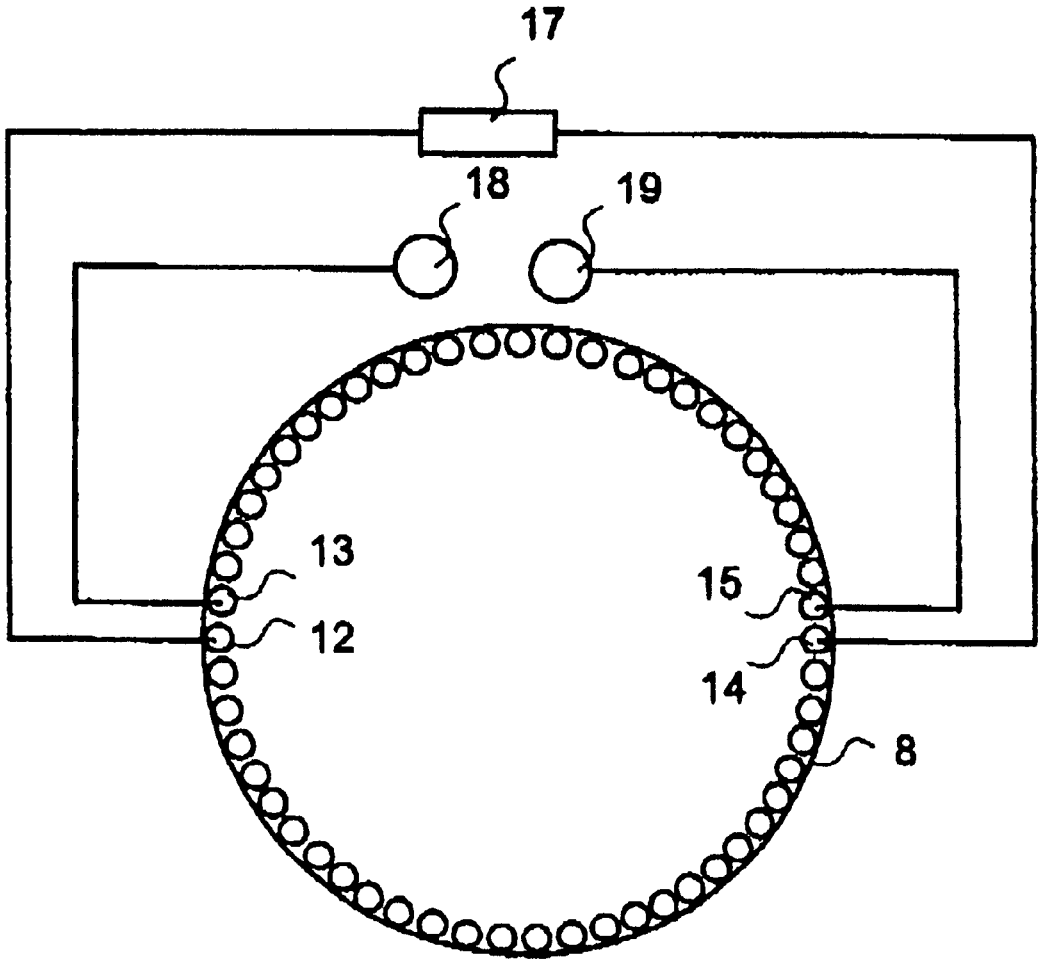
Figure 4A:
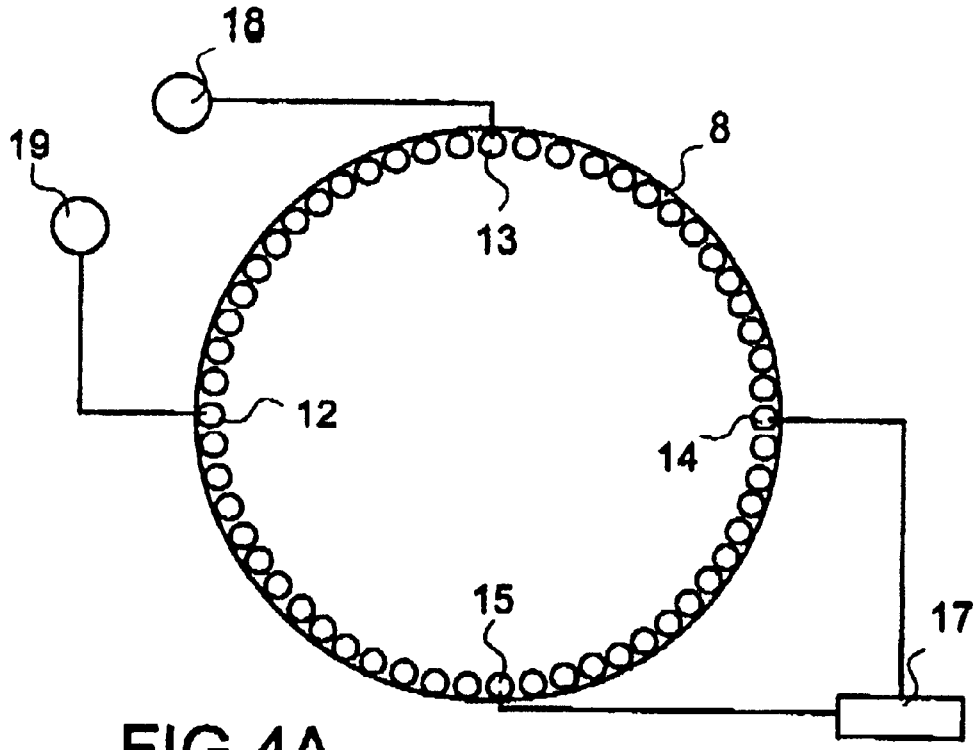
Figure 4B:
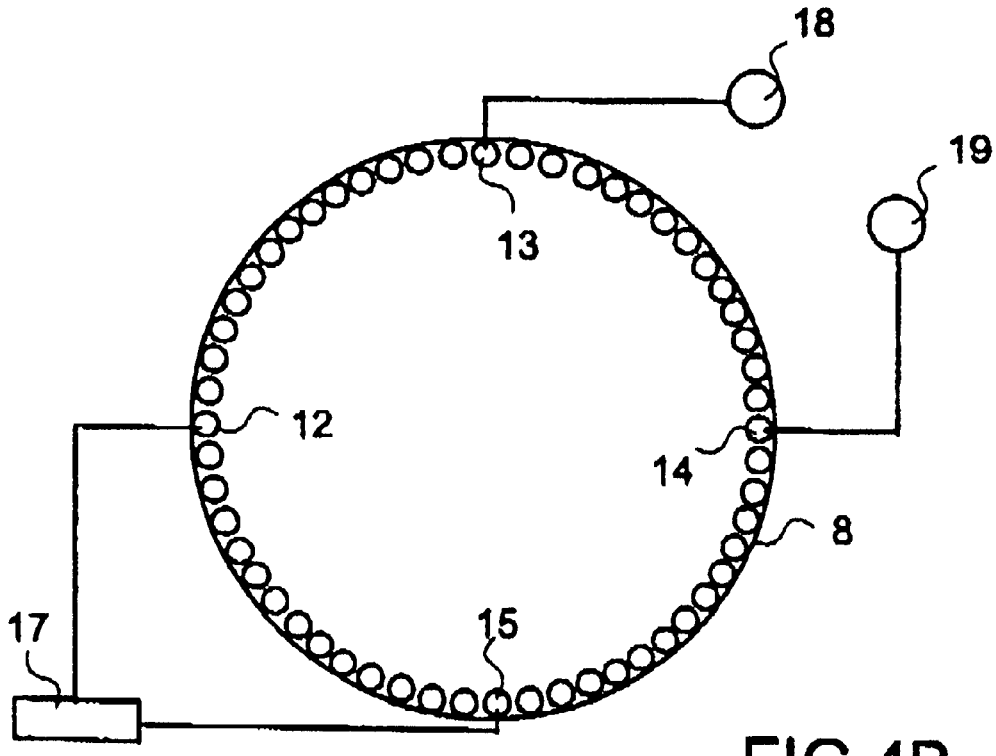

FIG. 3 is a schematic plan view of a 4-point measurement configuration for determining the electrical resistance; and FIGS. 4A and 4B are schematic plan views of a Van der Pauw measurement configuration for determining the electrical resistance; and FIGS. 5–8 are partial, diagrammatic sectional views of a semiconductor structure for illustrating an embodiment of the method according to the invention.

DESCRIPTION OF THE PREFERRED EMBODIMENTS

Figure 1:
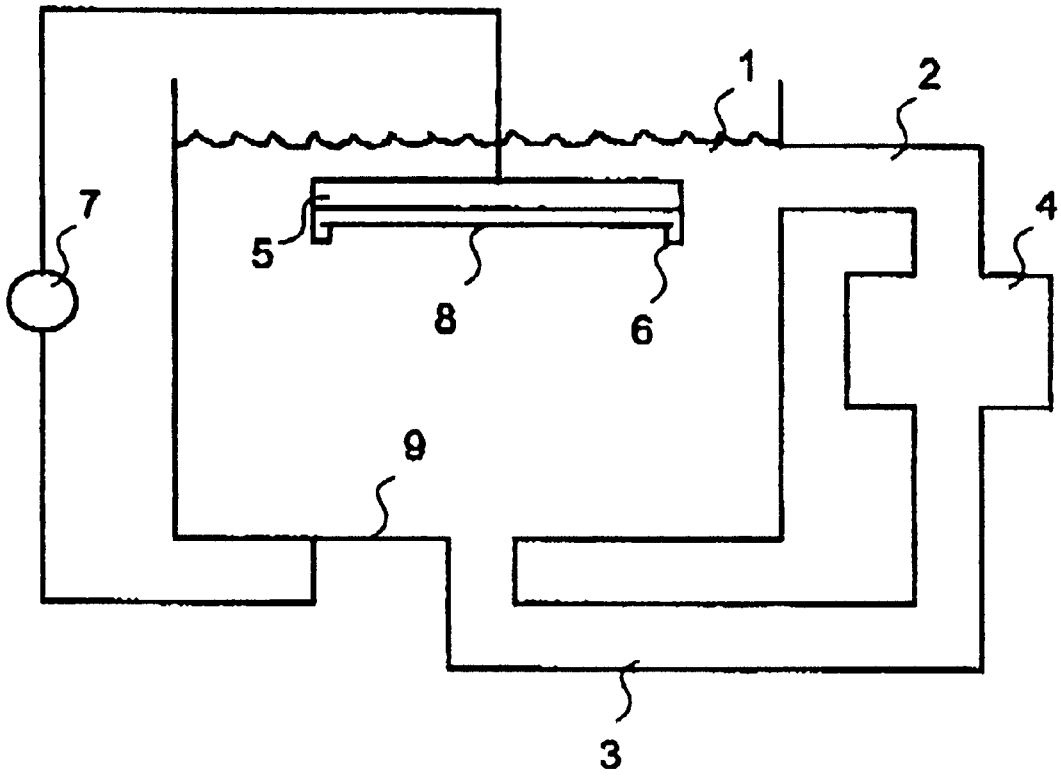
FIG. 1 is a simplified diagrammatic sectional view of an apparatus for carrying out an electrochemical metal deposition according to the invention.

Referring now to the figures of the drawings in detail and first, particularly, to FIG. 1 thereof, there is shown a schematic illustration of an apparatus for carrying out electrochemical metal deposition. The apparatus shown in FIG. 1 includes a container containing the electrochemical solution 1. The silicon wafer 8, or the silicon substrate, onto which the metal layer, for example the copper layer, is to be deposited, is immersed in the electrochemical solution 1 using a holder 5. In this case, the silicon wafer 8 is held by a clamping ring 6, which isolates the edge of the silicon wafer 8 from the electrochemical solution 1.

The electrochemical solution 1 is passed by a pump 4 through an inlet 3 from underneath onto the silicon wafer 8. An outlet 2, through which the electrochemical solution 1 can flow to the pump 4, is provided at the upper end of the container. In the process, the electrochemical solution 1 is filtered and cleaned. The corresponding filters are not shown in FIG. 1. In order that the desired metal, for example copper, can be deposited on the silicon wafer 8, an electrical power source 7 is connected both to the holder 5 and to the base 9 of the container. The base 9 of the container is in this case kept at a positive potential, while the holder 5, and thus the silicon wafer, is kept at a negative potential.

If the aim is to deposit copper on the surface of the silicon wafer 8, then the electrochemical solution 1 preferably contains copper sulfate, sulfuric acid and hydrochloric acid, as well as leveling agents and brightening agents. By way of example, "MLO", produced by Enthone-OMI Inc., New Haven, Conn., can be used as the leveling agent. "MD", likewise produced by Enthone-OMI Inc., New Haven, Conn., can be used as the brightening agent. Copper ions are required for an electrochemical deposition of copper on the silicon wafer 8. Due to the polarity of the electrical power source 7, copper ions ($Cu=Cu^{++}+2e^{-}$) are produced continuously at the base 9 of the container. These copper ions then migrate from the base 9 of the container to the silicon wafer 8 where a chemical reaction takes place on the surface of the silicon wafer ($Cu^{++}+2e=Cu$), as a result of which copper is deposited on the surface of the silicon wafer. Apart from the described direct-current deposition process, deposition based on a pulsed current can also be used.

Figure 2:
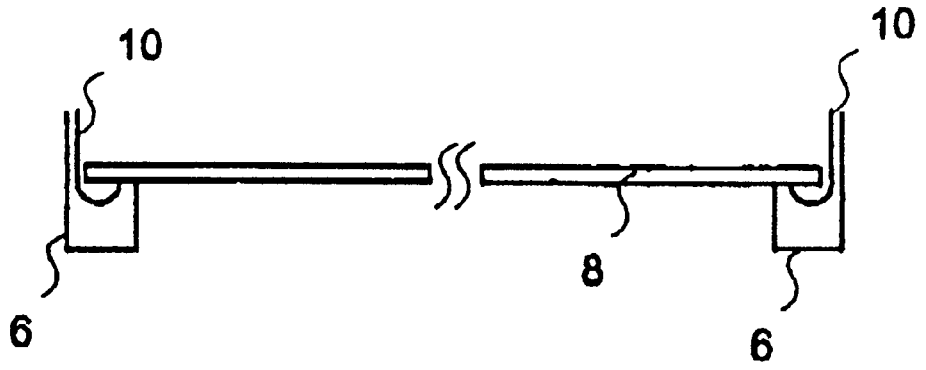
FIG. 2 is an enlarged diagrammatic view of a detail of the apparatus shown in FIG. 1.

FIG. 2 shows an enlarged illustration of the silicon wafer 8. The silicon wafer 8 is held by the clamping ring 6, which seals the edge of the silicon wafer 8 from the electrochemical solution 1. This means that no copper ions can reach the edge of the silicon wafer. Accordingly, no copper is deposited on the edge of the silicon water 8. The connections 10 make contact with the edge of the silicon wafer. In this case, the connections 10 are likewise sealed from the electrochemical solution 1 by the clamping ring 6. The connections 10 make contact with a starting layer 27 (see FIG. 6 and FIG. 7) on the silicon wafer 8.

FIG. 3 shows a schematic illustration of a measurement configuration for determining the electrical resistance of the deposited copper layer. FIG. 3 shows a plan view of the silicon wafer 8 with the contact points of the connections 10 on the edge of the silicon wafer 8 being marked by circles.

Figure 8:
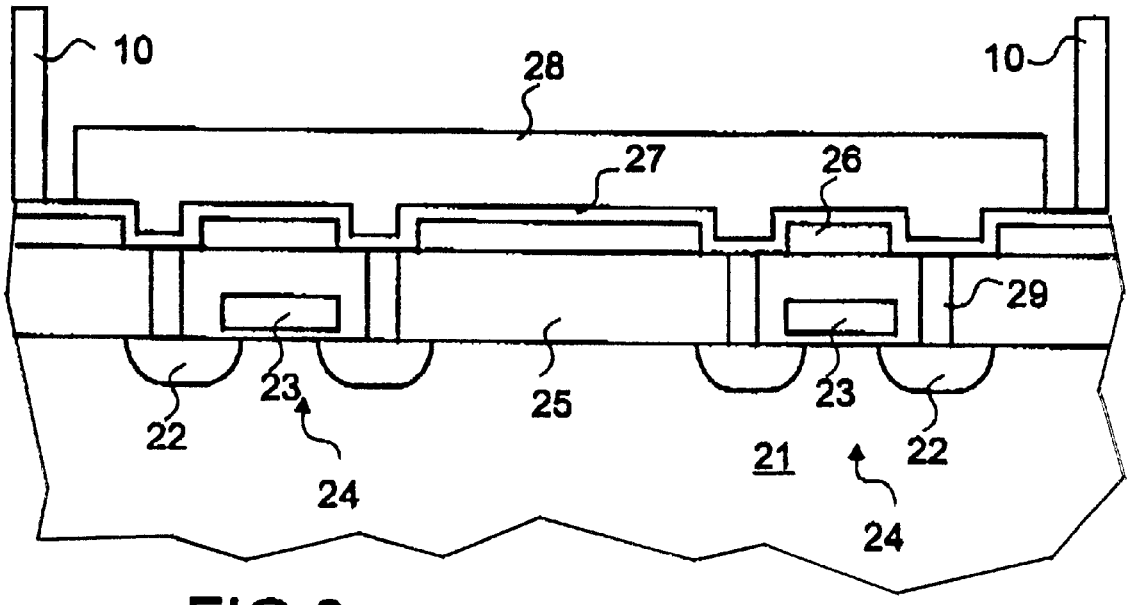

A so-called 4-point measurement is carried out in order to measure the electrical resistance of the copper layer 28 (see FIG. 8). In this case, the connections 12 and 14, for example, are connected to an electrical power source or current sourcce 17. The electrical power source 17 ensures that a constant current flows between the connections 12 and 14. This current flow results in a potential difference between the connections 13 and 15. This potential difference is measured by using the voltage measurement device 18 to measure the potential at the connection 13. The potential at the connection 15 is measured in a corresponding manner by the voltage measurement device 19. The resistance of the copper layer 28 (see FIG. 8) can be determined from the measurements of the potential difference between the connections 13 and 15 and with a knowledge of the applied current. Since the resistance of the copper layer 28 is essentially inversely proportional to the layer thickness of the copper layer 28, the thickness of the copper layer can be determined from the resistance of the copper layer.

In the situation shown in FIG. 3, the resistance of the copper layer is measured from left to right across the silicon wafer. The resistance of the copper layer can, of course, also be measured in any other desired direction across the silicon wafer. All that is required to do this in any given case is to connect opposite connections to the electrical power source 17 and to the voltage measurement devices 18 and 19. If all these resistance measurements are carried out simultaneously or successively, then the resistance of the copper layer can be determined in any desired direction. This allows to identify inhomogeneities in the copper layer.

FIGS. 4A and 4B show a schematic illustration of a further measurement configuration for determining the electrical resistance of the deposited copper layer. FIG. 4A likewise shows a plan view of the silicon wafer 8, with the contact points of the connections 10 on the edge of the silicon wafer 8 being marked by circles. The so-called Van der Pauw measurement is now carried out in order to measure the electrical resistance of the copper layer 28 (see FIG. 8). In this case, the connections 14 and 15, for example, are connected to an electrical power source 17. The electrical power source 17 ensures that a constant current flows between the connections 14 and 15. This current flow produces a potential difference $V_1$, between the connections 12 and 13.

In FIG. 4B, the connections 12 and 15 are connected to an electrical power source 17. The electrical power source 17 ensures that a constant current flows between the connections 12 and 15. This current flow results in a potential difference $V_2$ between the connections 13 and 14. Once again, the resistance of the copper layer 28 (see FIG. 8) and thus the thickness of the copper layer can be determined from the measurements of the potential differences $V_1$, and $V_2$ and by knowing the applied current.

Figure 5:
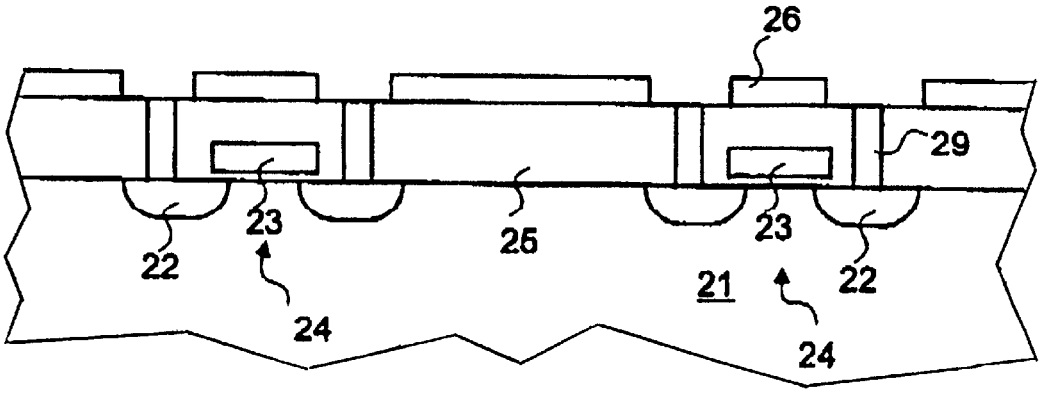

FIGS. 5–8 schematically illustrate a method according to one embodiment of the invention. FIG. 5 shows a silicon substrate 21, in which the transistors 24 have already been produced. The transistors 24 in this case each include the diffusion regions 22 and the gate 23. The transistors 24 are produced using conventional methods, which will not be explained here. An insulating layer 25, for example a $SiO_2$ layer, is applied on the silicon substrate 21 with the transistors 24. Depending on the method used to produce the transistors 24, a number of insulating layers can also be applied. Contact holes 29 are produced in the insulating layer 25, and these are filled with conductive material and then are used to make contact with the diffusion regions 22. An insulating layer 26 was then applied and structured in order to produce the interconnects. This completes the first step of the new method. A substrate, in particular a pre-structured substrate, has been produced.

Figure 6:
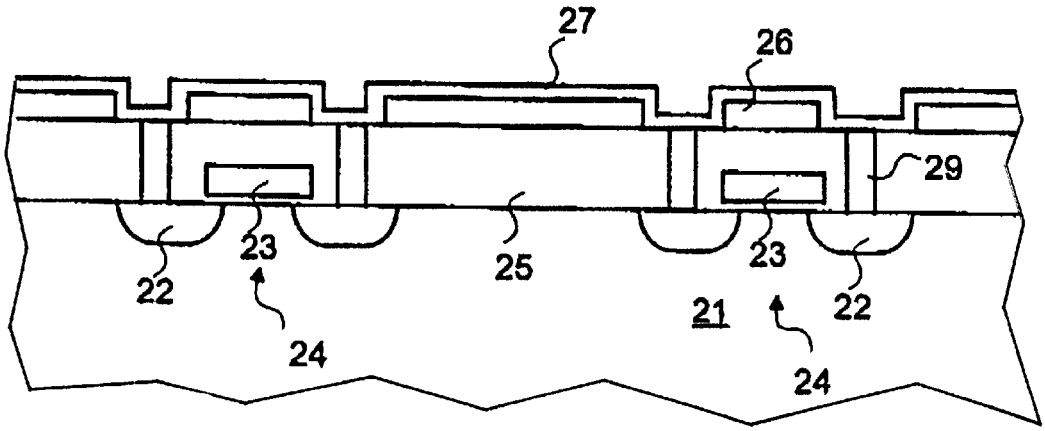
Figure 7:
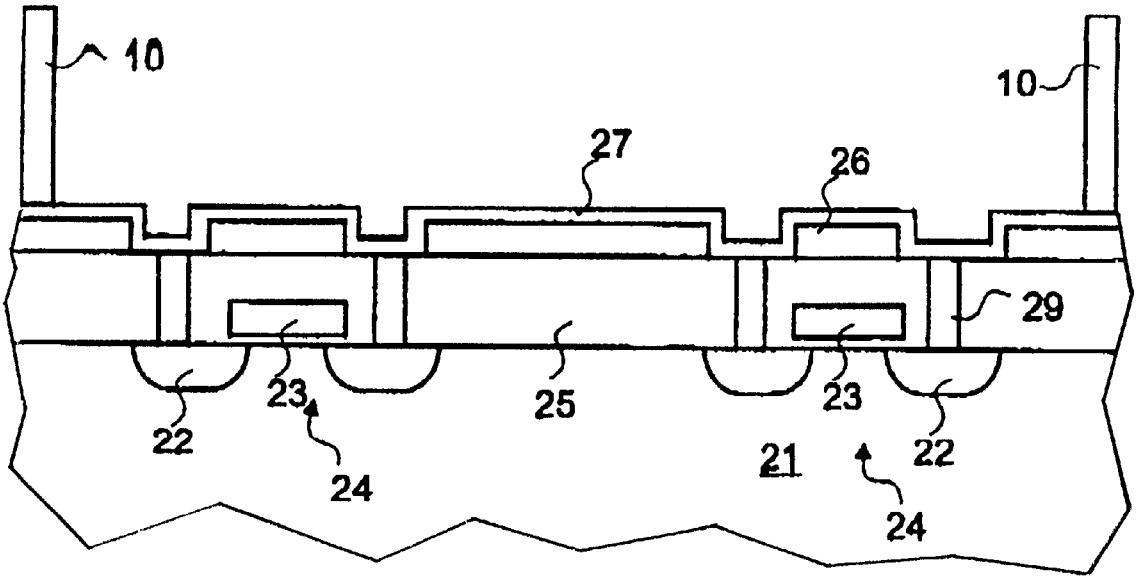

A barrier layer (not shown) is now produced on this substrate. A tantalum or tantalum-nitride layer can be used, for example, as the barrier layer. The thickness of this barrier layer is normally 30 to 40 nm. A starting layer 27 is now produced on the barrier layer (FIG. 6). The thickness of the starting layer is in this case about 100 nm. Since the aim is to deposit a copper layer in the present example, a copper layer is used as the starting layer. The starting layer 27 serves as a seed layer for the subsequent electrochemical deposition process. The starting layer 27 can be applied to the silicon wafer through the use of PVD (Physical Vapor Deposition) or CVD (Chemical Vapor Deposition) methods. If a tantalum or tantalum-nitride layer is used as the starting layer 27, then there is no need to apply any additional barrier layer. Once the starting layer 27 has been applied, the starting layer 27 is electrically contacted via the connections 10 at the edge of the silicon substrate 21. FIG. 7 illustrates this stage.

The copper layer 28 is then deposited as described in conjunction with FIG. 1. No copper deposition takes place at the edge of the silicon wafer due to the fact that the edge of the silicon wafer 8 is sealed from the electrochemical solution 1. In a corresponding way, the connections 10 are not contaminated with copper. During the electrochemical copper deposition process an electrical resistance measurement is carried out continuously or at predetermined time intervals via the connections 10, as described in conjunction with FIG. 3 or FIGS. 4A and 4B, and the layer thickness of the deposited copper layer 28 is determined from the resistance measurement.

In this case, the electrochemical copper deposition process is continued, depending on the thickness of the already deposited copper layer 28, until a copper layer 28 with a predetermined thickness is produced (FIG. 8).

As an alternative to this, the layer thickness measurement can also be carried out after completion of the electrochemical copper deposition process. Then, if required, at least one further electrochemical copper deposition process is carried out depending on the thickness of the already deposited copper layer 28, until a copper layer 28 with a predetermined thickness is produced.

The described methods have the advantage that any silicon wafer can be measured and thus monitored with a minimal time loss. Accordingly, a predetermined layer thickness can be maintained across a large number of wafers, with high accuracy. CMP steps to be carried out subsequently can rely on the fact that the copper layer to be removed has a predetermined thickness. The operating parameters of the CMP systems can be set accordingly. No silicon wafer need be removed from the production process, and the number of unusable silicon wafers can be considerably reduced.

We claim:

1. A method for producing a metal layer with a given thickness, the method which comprises:

providing a substrate;

applying a starting layer on the substrate;

electrically contacting the starting layer via connections at an edge of the substrate;

depositing a metal layer by using a deposition process;

measuring an electrical resistance via the connections, subsequent to the depositing step;

determining a layer thickness of the metal layer from the electrical resistance; and carrying out at least one further depositing step until a given layer thickness is reached, if the layer thickness determined in the determining step is less than the given layer thickness.

2. The method according to claim 1, which comprises using, as the deposition process, an electrochemical deposition in a chemical solution.

3. The method according to claim 2, which comprises passing a current for the electrochemical deposition through the connections.

4. The method according to claim 1, which comprises depositing a copper layer as one of the metal layer and the starting layer.

5. The method according to claim 1, which comprises using, as the starting layer, a layer selected from the group consisting of a copper layer, a titanium layer, a titanium nitride layer and a tantalum layer.

6. The method according to claim 4, which comprises depositing the copper layer from a solution containing copper sulfate, sulfuric acid and hydrochloric acid.

7. The method according to claim 6, which comprises providing leveling agents and brightening agents in the solution.

8. The method according to claim 1, which comprises measuring the electrical resistance diagonally across the substrate.

9. The method according to claim 1, which comprises measuring the electrical resistance with a 4-point measurement process.

10. The method according to claim 1, which comprises measuring the electrical resistance with a Van der Pauw measurement process.

11. The method according to claim 1, which comprises:

providing a multitude of the connections along the edge of the substrate; and measuring the electrical resistance by measuring along a multitude of directions diagonally across the substrate.

12. The method according to claim 1, which comprises keeping the connections free of the metal layer.

13. The method according to claim 1, which comprises sealing the connections against a chemical solution used for the deposition process.

14. The method according to claim 1, which comprises providing a silicon substrate as the substrate.

15. A method for producing a metal layer with a given thickness, the method which comprises:

providing a substrate;

applying a starting layer on the substrate;

electrically contacting the starting layer via connections at an edge of the substrate;

depositing a metal layer by using a deposition process;

measuring, during the depositing step, an electrical resistance via the connections;

determining a layer thickness of the metal layer from the electrical resistance; and continuing the depositing step in dependence on the layer thickness of the metal layer already deposited, until a given layer thickness is achieved.

16. The method according to claim 15, which comprises continuously measuring the electrical resistance during the depositing step.

17. The method according to claim 15, which comprises measuring the electrical resistance at given time intervals during the depositing step.

18. The method according to claim 15, which comprises measuring the electrical resistance with a resistance measurement using a given frequency.

19. The method according to claim 15, which comprises using, as the deposition process, an electrochemical deposition in a chemical solution.

20. The method according to claim 19, which comprises passing a current for the electrochemical deposition through the connections.

21. The method according to claim 15, which comprises depositing a copper layer as one of the metal layer and the starting layer.

22. The method according to claim 15, which comprises using, as the starting layer, a layer selected from the group consisting of a copper layer, a titanium layer, a titanium nitride layer and a tantalum layer.

23. The method according to claim 21, which comprises depositing the copper layer from a solution containing copper sulfate, sulfuric acid and hydrochloric acid.

24. The method according to claim 23, which comprises providing leveling agents and brightening agents in the solution.

25. The method according to claim 15, which comprises measuring the electrical resistance diagonally across the substrate.

26. The method according to claim 15, which comprises measuring the electrical resistance with a 4-point measurement process.

27. The method according to claim 15, which comprises measuring the electrical resistance with a Van der Pauw measurement process.

28. The method according to claim 15, which comprises:

providing a multitude of the connections along the edge of the substrate; and measuring the electrical resistance by measuring along a multitude of directions diagonally across the substrate.

29. The method according to claim 15, which comprises keeping the connections free of the metal layer.

30. The method according to claim 15, which comprises sealing the connections against a chemical solution used for the deposition process.

31. The method according to claim 15, which comprises providing a silicon substrate as the substrate.

* * * * *